United States Patent [19]

McNair, Jr. et al.

[11] Patent Number: 5,071,599

[45] Date of Patent: Dec. 10, 1991

[54] PROCESS FOR THE PRODUCTION OF CELLULOSE ESTER FIBRETS

[75] Inventors: Samuel S. McNair, Jr., Pembroke, Va.; Jimmy W. Evans, Concord, N.C.

[73] Assignee: Hoechst Celanese Corporation, Charlotte, N.C.

[21] Appl. No.: 627,279

[22] Filed: Dec. 14, 1990

[51] Int. Cl.[5] ..... B29B 9/10; D01F 13/02

[52] U.S. Cl. ..... 264/5; 264/8; 264/11; 264/14; 264/38; 536/58; 536/69; 536/77

[58] Field of Search ..... 264/11, 13, 14, 38, 264/5, 8; 536/58, 69, 76, 77

[56] References Cited

U.S. PATENT DOCUMENTS

| | | | |
|---|---|---|---|
| 3,042,970 | 7/1962 | Terenzi | 264/14 |
| 3,961,007 | 6/1976 | Caputi, Jr. et al. | 264/140 |
| 4,047,862 | 9/1977 | Keith | 425/8 |
| 4,192,838 | 11/1980 | Keith | 264/10 |
| 4,205,025 | 5/1980 | Hart et al. | 264/14 |

*Primary Examiner*—Mary Lynn Theisen

*Attorney, Agent, or Firm*—Robert H. Hammer, III

[57] ABSTRACT

A process for the production of cellulose ester fibrets wherein a solution of the cellulose ester is contacted with a non-solvent for the cellulose ester in a precipitation zone under shearing conditions, and a solvent-non-solvent mixture is separated from the formed fibrets and recycled to the precipitation zone.

7 Claims, 1 Drawing Sheet

PROCESS FOR THE PRODUCTION OF CELLULOSE ESTER FIBRETS

This invention relates to an improved process for the production of cellulose ester fibrets. In another aspect this invention relates to a process for the production of cellulose ester fibrets wherein a solvent-nonsolvent mixture is recycled to the fibret precipitation zone.

BACKGROUND OF THE INVENTION

Short fibrillar cellulose ester material (termed fibrets) are employed in a variety of applications such as in the manufacture of tobacco smoke filters and as a replacement for clay and titanium dioxide in paper opacification. Fibrets can be produced using an unstable wet spinning process in which the fibrets are precipitated out of an organic solution of the polymer and formed, in a nonsolvent, under controlled shearing conditions. The formed fibrets are in a mixture of the organic solvent and nonsolvent. The mixture is then screened or filtered to increase the fibret concentration and the fibret concentrate thereafter heated to evaporate the organic solvent. The solvent is separated by distillation from the solvent-nonsolvent mixtures withdrawn from the screening or filtering and the fibret concentrate forming steps.

In the precipitation step, a large volume of nonsolvent is required which must be heated. Additionally, large distillation capacity is required to separate the solvent from the nonsolvent in the mixtures of such solvent and nonsolvent withdrawn from the filter and fibret concentration steps. Thus, it would be desirable to reduce the energy and capital costs associated with the precipitation and subsequent distillation steps.

SUMMARY OF INVENTION

In the production of cellulose ester fibrets by precipitation of the fibrets from a solvent solution of such fibrets into a nonsolvent, an improved process is provided whereby the solvent-nonsolvent mixtures separated from the product fibrets is recycled to the precipitation zone. Preferably, such recycle is continued until the concentration of solvent in the recycle stream is at least 10.0 weight percent.

DETAILED DESCRIPTION OF THE INVENTION

Figure 1:
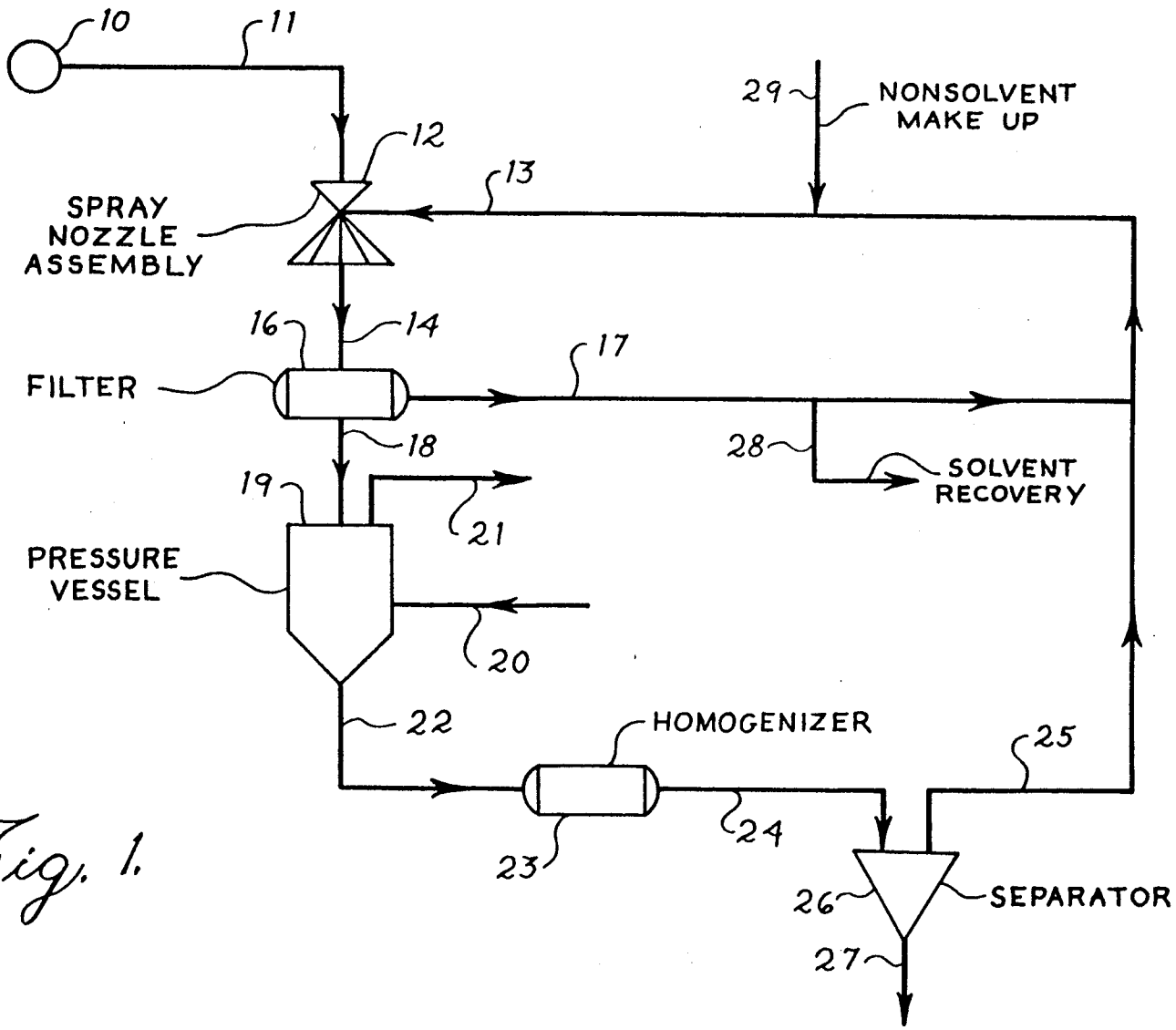
FIG. 1 is a schematic flow sheet of the process of the invention.

Referring to FIG. 1, a supply 10 of cellulose ester in a liquid mixture is prepared, such liquid mixture comprising two miscible components: an organic solvent such as acetone, methyl ethyl ketone, acetaldehyde or ethyl acetate and a miscible liquid nonsolvent for the cellulose ester such as water, methanol or ethanol. The liquid nonsolvent comprises from about 2 to about 20 percent by weight of the solvent and nonsolvent mixture. The preferred organic solvent is acetone which is miscible with the preferred nonsolvent, water.

The cellulose esters of this invention include cellulose acetate, cellulose triacetate, cellulose acetate butyrate, benzyl cellulose, or mixtures thereof with cellulose acetate being the preferred cellulose ester. Preferably, the cellulose esters of this invention are prepared from an acetylation grade wood pulp with higher than 90 percent by weight of hemicellulose. It is also preferred that high purity cellulose esters be employed.

The concentration of cellulose ester in the solvent and nonsolvent mixture should preferably be from about 5 to about 15 percent by weight with the particular concentration of the cellulose ester being dependent upon the method selected to form the fibrets. The cellulose ester, solvent and nonsolvent mixture is then introduced into the precipitation nonsolvent in a fibret precipitation zone under shearing conditions.

A suitable method for producing the fibrets is described in U.S. Pat. No. 4,192,838 which is incorporated herein by reference thereto. When employing the spray nozzle described therein, the cellulose ester dissolved in the solvent mixture is passed at an elevated temperature and under pressure via line 11 through a capillary needle of spray nozzle assembly 12 situated in the throat of a venturi tube through which a coagulation heated nonsolvent and solvent mixture as subsequently described is passed from conduit 13. The temperatures of the feeds to the spray nozzle assembly will be dependent upon the selected ester, solvent and nonsolvent. When employing cellulose acetate, acetone and water, the temperature in the spray nozzle assembly will normally range from 120° F. to 170° F.

The shearing high velocity of the nonsolvent stream in the venturi throat region attenuates the cellulose ester-solvent mixture and additionally extracts the solvent, forming fibrets. By changing the concentration of the cellulose ester in the solvent and nonsolvent mixture, the flow rate of the solvent and nonsolvent mixture, or the temperature of the solvent and nonsolvent mixture, the size, degree of fibrillation and length of the fibrets can be controlled. The term "fibret" as employed herein refers to a high surface area, cellulose ester fibrillar material having surface areas in excess of 5.0 square meters per gram, lengths of less than 1000 microns and diameters of from about 0.5 to 50 microns.

Another suitable method of producing the fibrets is described in U.S. Pat. No. 4,047,862, also incorporated herein by reference thereto. As described therein the cellulose acetate, solvent and nonsolvent mixture is extruded through an orifice into a heated region of shear and high draw in a precipitation bath containing a nonsolvent for the ester.

Mineral additives such as titanium oxide, barium sulfate and aluminum oxide can be included in the cellulose ester-solvent mixture passed to the capillary needle. If included, the concentration of such additives can be up to 75 percent of the weight of the cellulose ester as part of the total solids.

The fibrets as a dilute slurry in the solvent and nonsolvent mixture is passed via conduit 14 to a filter means 16. Suitably, filter means 16 can comprise a commercially available screen which forms a thickened slurry of the fibrets passed via conduit 18 to a pressure vessel 19. A mixture of the solvent and nonsolvent is withdrawn from filter means 16 via conduit 17.

Saturated steam is introduced into pressure vessel 19 via conduit 20 at a rate so as to maintain the hereafter described temperature. The pressure within pressure vessel 19 is normally within the range of about 0 to about 15 pounds per square inch gauge (psig) and the temperature within vessel is such as to separate substantially all of the remaining solvent from the fibrets at the vessel pressure. Normally, when producing cellulose acetate fibrets from an acetone-water mixture the pressure within vessel 20 is in the range of about 10 psig to about 12 psig and the temperature is in the range of about 220° to about 240° F. Vaporized solvent and nonsolvent are withdrawn from pressure 19 via conduit 21.

The fully formed fibrets, substantially free of solvent, are withdrawn from pressure vessel 19 as a slurry in the nonsolvent, normally less than 2.0 weight percent solids, via conduit 22 and passed to a homogenizer vessel 23 wherein size reduction of the large fibrets can be effected. Size reduction can be accomplished by passing the dilute slurry through a narrow orifice with a high pressure drop. After homogenization, the slurry can be passed, via conduit 24, to a nonsolvent separator 26, such as a centrifuge, wherein the nonsolvent is separated from the fibrets. Product pill-free fibrets, normally containing from about 65 to about 88 weight percent nonsolvent are withdrawn from separator 26 via conduit 26.

The product fibrets of the invention can be used as filter aids and in the production of heavy weight paper. The fibrets because of their pill-free characteristics are particularly suitable in the production of fine paper, filtration paper, and lightweight non-wovens applications.

The solvent and nonsolvent mixture withdrawn from filter means 16 via conduit 17 can be recycled to spray nozzle assembly 12 via conduit 13. Optionally, the recycle stream can include the nonsolvent stream withdrawn from separator 26 via conduit 25. Make-up nonsolvent can be added to the recycle stream via conduit 29. If the nonsolvent makeup is not water, the nonsolvent withdrawn from pressure vessel 19 via conduit 22 and recycled via conduits 25 and 13 will comprise a mixture of water and makeup nonsolvent.

The recycle operation can be continued until the concentration of the solvent in conduit 13 is at least 7.5 weight percent, preferably at least 12.5 weight percent when the cellulose ester is cellulose acetate, the solvent is acetone and the nonsolvent is water. When the concentration of solvent in conduit 17 becomes a maximum of 15.0 weight percent when the cellulose ester is cellulose acetate, the solvent is acetone and the nonsolvent is water, a portion of the mixture withdrawn from filter means 17 via conduit 17 can be passed via conduit 28 to a conventional solvent recover system.

The invention is further illustrated by the following example.

EXAMPLE

A cellulose acetate dope comprising 10.0 weight percent cellulose acetate, 81.1 weight percent acetone and 9.0 weight percent water was passed to spray nozzle assembly 12 via conduit 11. A recycle stream comprising 7.5 weight percent acetone and 92.5 weight percent water was passed via conduit 13 to spray nozzle assembly 12.

A dilute fibret slurry comprising 0.44 weight percent cellulose acetate fibrets, 3.54 weight percent acetone and 96.2 weight percent water was passed to filter means 16. The slurry concentrate withdrawn from filter means 16 and passed to pressure vessel 19 via conduit 18 comprised 2.00 weight percent cellulose acetate fibrets, 3.54 weight percent acetone and 94.46 weight percent water. The liquid stream withdrawn from filter means 16 and recycled via conduits 17 and 13 to spray nozzle assembly 12 comprised 10.0 weight percent acetone and 90.0 weight percent water.

Saturated steam was introduced into pressure vessel 19 via conduit 20 at a rate and temperature so as to achieve and maintain a temperature in vessel 19 of 230° F. Vessel 19 was pressurized to a pressure of 10 psig. A vaporized stream comprising 12.2 weight percent acetone and 87.8 weight percent water was withdrawn from vessel 19 via conduit 21. The fibret slurry withdrawn from vessel 19 via conduit 22 comprised 1.94 weight percent cellulose acetate and 98.06 weight percent water and was substantially free of chips and pills.

Although the invention has been described in detail with respect to specific embodiments, it should be noted that this invention is by no means limited to those specific embodiments.

What is claimed is:

1. A process for the production of fibrillar cellulose ester material comprising the steps of:

providing a dope comprising a cellulose ester, a solvent for said ester, and a nonsolvent for said ester, said solvent and said nonsolvent being miscible;

attenuating said dope, under conditions of high shear, in a precipitation zone and in the presence of a coagulation mixture comprising said solvent and said nonsolvent, whereby a slurry of cellulose ester fibular material is formed;

separating a liquid component from said slurry, said liquid component comprising said solvent and said nonsolvent; sand recycling a stream comprising said liquid component to said coagulation mixture in said precipitation zone.

2. The process according to claim 1 wherein said dope contains from about 5 to about 15 percent cellulose ester.

3. The process according to claim 1 wherein said dope contains from about 2 to about 20 percent nonsolvent.

4. The process according to claim 1 wherein said cellulose ester is cellulose acetate, said solvent is acetone, and said nonsolvent is water.

5. The process according to claim 1 wherein said recycle stream comprises at least 7.5 weight percent solvent.

6. The process according to claim 1 wherein said recycle stream comprises at least 10 weight percent solvent.

7. The process according to claim 1 wherein said solvent of said recycle stream does not exceed 15 weight percent.

* * * * *